US007604730B1

(12) United States Patent
Humblot et al.

(10) Patent No.: US 7,604,730 B1
(45) Date of Patent: Oct. 20, 2009

(54) COKING REDUCTION IN CRACKING REACTORS

(75) Inventors: Francis Humblot, Lanneplaa (FR); Claude Brun, Idron (FR); Harry M. Woerde, Rijn (NL); Paul F. Van Den Oosterkamp, The Hague (NL)

(73) Assignee: Arkema France, Colombes (FR)

( * ) Notice: Subject to any disclaimer, the term of this patent is extended or adjusted under 35 U.S.C. 154(b) by 290 days.

(21) Appl. No.: 10/088,738

(22) PCT Filed: Sep. 18, 2000

(86) PCT No.: PCT/FR00/02583

§ 371 (c)(1),
(2), (4) Date: Jul. 23, 2002

(87) PCT Pub. No.: WO01/21731

PCT Pub. Date: Mar. 29, 2001

(30) Foreign Application Priority Data

Sep. 24, 1909 (FR) ..... 99 11965

(51) Int. Cl.
*C10G 9/16* (2006.01)

(52) U.S. Cl. ..... 208/48 R; 208/48 AA; 208/50; 208/61; 208/106; 208/130; 208/131; 585/648; 585/650; 585/950

(58) Field of Classification Search ..... 208/48 R, 208/48 AA, 50, 61, 106, 130, 131; 585/648, 585/650, 950

See application file for complete search history.

(56) References Cited

U.S. PATENT DOCUMENTS

| | | | | |
|---|---|---|---|---|
| 4,099,990 | A | 7/1978 | Brown et al. | 148/6.35 |
| 4,410,418 | A | 10/1983 | Kukes et al. | 208/48 R |
| 4,692,243 | A | 9/1987 | Porsch et al. | 210/198.2 |
| 5,284,994 | A * | 2/1994 | Brown et al. | 585/648 |
| 5,565,087 | A * | 10/1996 | Brown et al. | 208/48 R |
| 5,616,236 | A * | 4/1997 | Brown et al. | 208/48 R |
| 5,656,150 | A | 8/1997 | Reed et al. | |
| 5,656,250 | A | 8/1997 | Tanaka et al. | 423/335 |
| 5,733,438 | A * | 3/1998 | Tong et al. | 208/48 R |
| 5,849,176 | A | 12/1998 | Zimmermann et al. | 208/48 |

FOREIGN PATENT DOCUMENTS

| | | |
|---|---|---|
| EP | 0 540 084 | 5/1993 |
| EP | 0 654 544 | 5/1995 |
| EP | 0 671 483 | 9/1995 |
| EP | 0 698 652 | 2/1996 |
| EP | 0 770 665 | 5/1997 |
| WO | WO 95/22588 | 8/1995 |

OTHER PUBLICATIONS

International Preliminary Examination Report (PCT/IPEA/409 and PCT/IPEA/416) (translated) issued for PCT/FR00/02583.
D.E. Brown et al., ACS Symp. Ser. 202 (1982) 23.
Chem. Techn. (Leipzig) 42 (1990) 146.

* cited by examiner

*Primary Examiner*—Glenn Caldarola
*Assistant Examiner*—Prem C. Singh
(74) *Attorney, Agent, or Firm*—Smith, Gambrell & Russell, LLP; Suzannah K. Sundby, Esq.

(57) ABSTRACT

The invention concerns a method for reducing coking on the metal walls of a reactor cracking hydrocarbons or other organic compounds and on the metal walls of a heat exchanger placed downstream of the cracking reactor, whereby the metal surfaces coming into contact with the organic substance to be cracked are pre-treated with a water vapor stream containing at least silicon and at least a sulphur compound.

25 Claims, No Drawings

COKING REDUCTION IN CRACKING REACTORS

The present invention relates to the field of the cracking of hydrocarbons or other organic compounds and has more particularly as subject-matter a process for reducing the coking on the walls of the cracking reactors and of the heat exchangers used to cool the compounds resulting from the cracking reaction.

In order to produce ethylene and other short-chain olefins, some hydrocarbon petroleum cuts are thermally cracked in metal tubular reactors. The resulting cracking gases are suddenly cooled in heat exchangers operating with a pressurized steam and water supply.

The tubular reactors used are preferably manufactured from chromium- and nickel-rich steels, whereas the heat exchangers, subjected to less severe constraints, are made of carbon steels. This same type of equipment is also encountered in producing other organic compounds, such as vinyl chloride by pyrolysis of 1,2-dichloroethane.

The efficiency of these steel reactors and heat exchangers depends on their resistance to the formation of a coke deposit on their internal walls in contact with the hydrocarbon to be cracked. Not only is this deposit harmful to the heat transfer but it reduces the effective cross section of the tube. The thickness of this coke deposit becomes such that the unit has to be shut down and subjected to expensive cleaning operations. In the majority of cases, the coke deposit is removed by high temperature gasification with a mixture of steam and air, which converts the coke to carbon oxides and re-establishes the initial characteristics of the cracking tube. When the deposit is produced in the heat exchangers, it is not possible structurally to carry out an in line decoking by gasification as the maximum temperatures allowable are too low for this reaction to be possible. Dismantling and decoking under manual conditions is necessary, a lengthy and difficult operation.

Despite optimized procedures which completely remove the coke, hydrocarbon cracking units, such as steam crackers, are frequently shut down in order to be subjected to fresh decoking cycles (after operating for 20 to 60 days). Furthermore, the oxidizing decoking treatment results in an increase in the catalytic activity of the metal cracking surface, which increases the rate of formation of coke. Thus, with the increase in the number of decoking operations to which the unit is subjected, the operating time decreases and the annual number of decoking operation increases. This long-term effect is technically and economically harmful since the maintenance costs become increasingly burdensome with the age of the unit for a lower annual operating rate.

For this reason, numerous efforts have been made over the years to find solutions which prevent the rapid coking of the internal metal walls of such units (cracking tubes and heat exchangers). Mention may more particularly be made, among the numerous solutions described in the literature, of the following:

1) A first method, disclosed in U.S. Pat. No. 4,099,990 and a subsequent publication by D. E. Brown et al. in ACS Symp. Ser. 202 (1982) 23, consists in forming, from alkyloxysilane, a silica coating by thermal decomposition in the vapour phase. A degree of improvement in the quality of the deposit can be obtained by using a silicone oil under specific conditions (Chem. Techn. (Leipzig) 42 (1990) 146). However, the process is rather expensive and the silica layer is not very stable beyond 750° C., a standard temperature for the cracking tubes of industrial plants.

2) U.S. Pat. No. 4,410,418 discloses a method for depositing a silica film from halosilane. The silyl compound is deposited liquid, as a film, on the metal surface to be treated and then, by exposure to moisture, a silica layer is formed by hydrolysis. This technique is difficult to apply to industrial plants because it is complicated to carry out; in addition, it is accompanied by a release of acids which can corrode the metal walls.

3) In Patents EP 540,084, EP 654,544 and EP 671,483, a protective layer of ceramic type is obtained from silyl compounds which do not comprise alkoxy groups and which are cracked in the presence of steam or of inert gas.

4) U.S. Pat. No. 4,692,243, U.S. Pat. No. 5,565,087, U.S. Pat. No. 5,616,236, U.S. Pat. No. 5,656,150, EP 698,652 and EP 770,665 all relate to a method for reducing the formation of coke in a hydrocarbon cracking tube. This method employs a silicon compound as a mixture with a tin compound. Some improvements have been made to it, such as the use of a reducing gas as carrier fluid for pretreating the cracking tube (U.S. Pat. No. 5,616,236) or the cracking of a desulphurized feedstock (Patent EP 770,665). This type of treatment remains expensive and the long-term effects of the tin on the metallurgy of the cracking tube and in the downstream sections are not known.

5) U.S. Pat. No. 5,849,176 discloses a process in which an additive composed of sulphur and of silicon is added to the feedstock of the cracking unit. The formation of coke is reduced to a greater extent than with a silyl compound alone or a sulphur compound alone. This patent claims the use of compounds based on sulphur and on silicon for reducing the coking in the cracking tubes and also in the heat exchangers placed in line subsequent to the cracking reactor. The amounts of silicon thus introduced end up being not insignificant and there is reason to fear blockages either in the cracking tube or in the section for treatment of the cracked gases.

6) Patent Application WO 95/22588 claims a process in which the cracking tube is pretreated in an inert gas (nitrogen, methane, hydrogen) with an additive based on sulphur and on silicon. A significant reduction in the amount of coke formed during the cracking of the hydrocarbonaceous feedstock is obtained. A true synergy exists between the sulphur and the silicon since no additive based on sulphur or on silicon alone leads to such results. However, the use of an inert carrier gas seems to be essential to this performance. Example 6 and FIG. 7 of this patent application show that the use of steam as carrier gas with an additive composed of trimethylsilylmethyl mercaptan does not result in any inhibition of the formation of coke.

Surprisingly, it has now been found that an additive composed of a mixture of sulphur compound and of silyl compound can be used to pretreat a hydrocarbon cracking tube in steam and thus to significantly reduce the formation of coke which accompanies the hydrocarbon cracking reaction.

By comparison with the process disclosed in Patent Application WO 95/22588, this novel process is easier to install in steam cracking units since, as carrier gas, it uses steam, a fluid already ordinarily available in the said units.

A first subject-matter of the invention is thus a process for reducing the coking on the metal walls of a reactor for the cracking of hydrocarbons or of other organic compounds and on the metal walls of a heat exchanger placed subsequent to the cracking reactor, characterized in that the metal surfaces coming into contact with the organic substance to be cracked are pretreated with a stream of steam comprising at least one silicon compound and at least one sulphur compound at a temperature of between 300 and 1100° C., preferably between 400 and 700° C. for the heat exchanger and preferably between 750 and 1050° C. for the cracking tube, for a time of between 0.5 and 12 hours, preferably between 1 and 6 hours.

The silicon compounds which can be used in the process according to the invention can comprise one or more silicon atoms and be inorganic or organic in nature.

Mention may more particularly be made, as inorganic silicon compounds, of silicon halides, hydroxides and oxides, silicic acids, and the alkali metal salts of these acids. Preference is given, among inorganic silicon compounds, to those which do not comprise halogens.

In the context of the present invention, it is preferable to use organic silicon compounds and, among these, those which only comprise silicon, carbon, hydrogen and, optionally, oxygen. The hydrocarbonaceous or oxycarbonaceous groups bonded to the silicon can comprise from 1 to 20 carbon atoms and are, for example, alkyl, alkenyl, phenyl, alkoxy, phenoxy, carboxylate, ketocarboxylate or diketone groups. Mention may be made, as nonlimiting examples of such compounds, of tetramethylsilane, tetraethylsilane, phenyltrimethylsilane, tetraphenylsilane, phenyltriethoxysilane, diphenyldimethoxysilane, tetraethoxysilane, tetramethoxysilane, ethyltrimethoxysilane, propyltriethoxysilane, vinyltriethoxysilane, poly(dimethylsiloxanes) and in particular hexamethyldisiloxane.

Organic silicon compounds comprising heteroatoms, such as halogen, nitrogen or phosphorus atoms, can also be used. Mention may be made, as examples of such compounds, of chlorotriethylsilane, (3-aminopropyl)triethoxysilane and hexamethyldisilazane.

Mention may be made, as sulphur compounds which can be used in the context of the present invention, of carbon disulphide and the compounds corresponding to the following general formula:

$$R^1—Sx—R^2$$

in which $R^1$ and $R^2$, which are identical or different, each represent a hydrogen atom or a hydrocarbonaceous group and x is a number greater than or equal to 1. Mention may be made, as examples of hydrocarbonaceous groups, of alkyl, alkenyl, cycloalkyl or aryl groups and their combinations, such as, for example, alkylaryl groups. Mention may more particularly be made, as non-limiting examples of organic sulphur compounds, of alkyl mercaptans, dialkyl sulphides, dialkyl disulphides and dialkyl polysulphides, and sulphur compounds present in some petroleum cuts (naphtha), such as thiophene and benzothiophene compounds. Use is preferably made of dimethyl sulphide, diethyl sulphide, hydrogen sulphide and in particular dimethyl disulphide.

The atomic ratio (Si:S) defining the proportions of the sulphur compound(s) to the silyl compound(s) is preferably between 5:1 and 1:5. Use is advantageously made of an Si:S ratio of between 2:1 and 1:2.

The concentration of the additive formed by the mixture of the sulphur compound or compounds and of the silyl compound or compounds can range from 50 to 5000 ppm by mass in the carrier fluid formed by steam alone or steam mixed with an inert gas (nitrogen, hydrogen, methane or ethane). This concentration is preferably between 100 and 3000 ppm.

The pressure of the carrier fluid is generally equal to that employed conventionally in cracking furnaces (between 1 and 20 bar absolute, advantageously between 1 and 5 bar absolute).

The pretreatment according to the invention can be carried out in any new cracking unit or in any existing unit after each decoking operation.

Another subject-matter of the invention is a cracking process in which a sulphur compound and, optionally, a silyl compound is added during the cracking to the feedstock of organic compounds. The temperature at which this addition takes place depends directly on the cracking conditions; it generally varies between 400 and 1000° C. and is preferably in 700 and 950° C.

The sulphur compounds and, optionally, the silicon compounds to be used in the context of this embodiment are the same as those mentioned above. The sulphur compound can be used alone or as a mixture with a silyl compound in an Si:S atomic ratio of less than or equal to 2:1, preferably of less than or equal to 1:2.

When the organic compound to be cracked already comprises sulphur in the organic form, only the silyl compound may optionally be added. In this case, an Si:S atomic proportion of less than or equal to 2:1, preferably of less than or equal to 1:2, has to be observed, it being necessary for the concentration of silicon in the compound to be cracked not to exceed 500 ppm.

The concentration of sulphur additive, with or without silyl compound, is chosen so that the concentration of sulphur in the organic compound to be cracked is between 10 and 1000 ppm by mass, preferably between 20 and 300 ppm by mass.

The following examples illustrate the invention without limiting it.

EXAMPLE 1

This example shows the effectiveness of a pretreatment based on sulphur and on silicon diluted in steam in inhibiting the formation of coke during the cracking of a petroleum cut which is rich in n-hexane (composition given in the following Table 1).

TABLE 1

Composition of the feedstock to be cracked

| Constituent | % w/w |
|---|---|
| Cyclopentane | 0.23 |
| 2,3-Dimethylbutane | 1.73 |
| 2-Methylpentane | 15.70 |
| 3-Methylpentane | 14.75 |
| n-Hexane | 52.28 |
| Methylcyclopentane | 12.30 |
| 2,4-Dimethylcyclopentane | 0.22 |
| Cycloheptane | 2.79 |

The cracking tube, with an internal diameter of 9 mm and a length of 4.6 m, was composed of Incoloy 800 HT steel and had an additional length of 1.45 m of the same tube for the preheating of the fluids.

During the pretreatment of the cracking tube, 1.92 kg/h of steam were introduced while maintaining an outlet temperature of the tube of 850° C. The additive is a mixture of dimethyl disulphide and of hexamethyldisiloxane exhibiting an Si:S atomic ratio of 2:1. This mixture, diluted in a nitrogen flow of 30 g/h, was injected into the steam after the preheating section at the rate of 5.7 g of additive per hour for 60 minutes. The concentration of additive in the steam was 2970 ppm by mass.

The cracking conditions were as follows:

| | |
|---|---|
| outlet temperature of the gases | 850° C. |
| pressure | 1.7 bar |
| contact time | 260 ms |
| throughput of the feedstock to be cracked | 4.8 kg/h |
| throughput of steam | 1.92 kg/h |
| dilution | 0.4 kg of steam/kg of hydrocarbons |
| cracking time | 6 hours |

The decoking of the reactor was carried out by means of a mixture of air (1.2 kg/h) and of steam (4.5 kg/h) brought to 800° C. and then 900° C. in order to completely oxidize the coke to carbon oxides. The concentrations of carbon oxides were continually measured by an infrared detector. A portion of the coke which detaches was entrained by the gas flow and then trapped by a cyclone. The mass of coke initially formed in the cracking tube is given by the sum of the coke which has been entrained and of the coke which has been oxidized.

A reference test was carried out under the same conditions (pretreatment, coking and decoking) but without addition of the dimethyl disulphide/hexamethyldisiloxane mixture.

By comparison with this reference test, the mass of coke was found to be reduced by 66% when the tube was pretreated with the dimethyl disulphide/hexmethyldisiloxane mixture.

EXAMPLE 2

This example shows the effectiveness of a pretreatment based on sulphur and on silicon diluted in steam in inhibiting the formation of coke during the cracking of propane.

The cracking tube was composed of Incoloy 800 HT steel with an internal diameter of 7.7 mm and a length of 9 meters. The gases were preheated to 200° C. before being introduced into the cracking tube.

The pretreatment used a mixed flow of steam (0.7 kg/h) and of nitrogen (3.5 kg/h) for 4 hours. The temperature of the gases at the outlet of the cracking tube was 1010° C. The additive was a mixture of dimethyl disulphide and of hexamethyldisiloxane exhibiting an Si:S atomic ratio of 1:2. This additive was injected at the inlet of the pyrolysis tube at the rate of 5.63 g/h, i.e. a concentration of 1340 ppm by mass in the gas flow.

The cracking conditions were as follows:

| | |
|---|---|
| outlet temperature of the gases | 910° C. |
| pressure | 1.4 bar |
| contact time | 150 ms |
| throughput of the feedstock to be cracked | 2.33 kg/h |
| throughput of steam | 0.7 kg/h |
| dilution | 0.3 kg of steam/kg of propane |
| conversion of the propane | 88-92% |
| selectivity for ethylene | 73-77% |
| selectivity for propylene | 23-27% |
| cracking time | 20 hours |

The decoking was carried out by means of air (240 g/h) diluted in nitrogen (1.2 kg/h) at a temperature of between 900 and 1000° C. The concentrations of carbon oxides were continually measured by an infrared detector. Coke entrainment phenomena were negligible, which made it possible to directly calculate the mass of coke formed from the total amounts of carbon oxides.

A reference test was carried out under strictly identical conditions but without addition of the additive based on dimethyl disulphide and on hexamethyldisiloxane.

By comparison with this reference test, the mass of coke was found to be reduced by 27% when the tube was pretreated with the dimethyl disulphide/hexamethyldisiloxane mixture.

EXAMPLE 3

This example shows the coke-inhibiting properties of a pretreatment based on sulphur and on silicon diluted in steam combined with a continuous addition of dimethyl disulphide to the feedstock.

The general experimental conditions and those of the pretreatment were identical to those of Example 2. The dimethyl disulphide was injected at the inlet of the cracking tube at the rate of 1.8 g/h for the 20 hours during which the cracking of the propane lasted.

A reference test was carried out under identical conditions but without the addition of the pretreatment additive based on dimethyl disulphide and on hexamethyldisiloxane.

By comparison with this reference test, the mass of coke was found to be reduced by 18% when the tube was pretreated with a dimethyl disulphide/hexamethyldisiloxane mixture.

EXAMPLE 4

This example shows the coke-inhibiting properties of a pretreatment based on sulphur and on silicon diluted in steam combined with a continuous addition to the feedstock of a dimethyl disulphide/hexamethyldisiloxane mixture.

The general experimental conditions and those of pretreatment were identical to those of Example 2. An additive composed of dimethyl disulphide and of hexamethyldisiloxane exhibiting an Si:S atomic ratio equal to 1:20 was injected at the inlet of the cracking tube at the rate of 1.88 g/h for the 20 hours during which the cracking of the propane lasted.

A reference test was carried out under identical conditions but without additions of the pretreatment additive and of the silyl compound during the cracking.

By comparison with this reference test, the mass of coke was found to be reduced by 17%.

COMPARATIVE EXAMPLE 5

The coke-inhibiting properties of a pretreatment based on an organic silicon compound alone (hexamethyldisiloxane) were compared with those of a pretreatment without addition of hexamethyldisiloxane.

The general experimental conditions were identical to those of Example 2 but using, as additive, hexamethyldisiloxane injected at the inlet of the cracking tube at the rate of 2.3 g/h during the 4 hours of pretreatment.

By comparison with a reference test carried out under strictly identical conditions but without addition of hexamethyldisiloxane, the mass of coke increased by 5% in the tube pretreated with hexamethyldisiloxane.

EXAMPLE 6

This example shows the effectiveness of a pretreatment by means of an additive based on sulphur and on silicon diluted in steam in inhibiting the formation of coke in a heat exchanger.

Equipment and Operating Conditions

The micropilot plant was divided into two parts, a cracking reactor followed by a heat exchanger. A small length of metal (carbon steel of P-22 type comprising 2.25% of chromium and 1.0% of molybdenum) was placed in the gas flow passing through this heat exchanger. The coking reactions took place on the surface of this length of metal, resulting in an increase in its mass which could be translated into rate of coking per unit of surface area.

The pretreatment conditions were as follows:

| | |
|---|---|
| temperature of the cracking reactor | 600° C. |
| contact time of the cracking reactor | 2 seconds |
| throughput of steam | 21 l/h |
| throughput of nitrogen | 7 l/h |
| concentration of additive | 1000 ppm |
| temperature of the heat exchanger | 600° C. |
| duration | 2 hours |

The additive based on sulphur and on silicon was a mixture of dimethyl disulphide and of hexamethyldisiloxane exhibiting an Si:S atomic ratio of 2:1. This additive was injected into the steam flow at the inlet of the cracking reactor.

The cracking conditions (coking phase) were as follows:

| | |
|---|---|
| temperature of the cracking reactor | 850° C. |
| contact time of the cracking reactor | 0.5 second |
| hydrocarbon to be cracked | isobutane |
| throughput of isobutane | 10 l/h |
| throughput of nitrogen | 10 l/h |
| severity of the cracking (propylene/ethylene) | 0.6 |
| temperature of the heat exchanger | 500° C. |
| duration | 1 hour |

The coke formed in the cracking reactor and the heat exchanger was removed (decoking) by treatment with air at high temperature in order to convert the carbon into gaseous carbon oxides.

Results

After the pretreatment by means of the additive based on sulphur and on silicon, a coking/decoking cycle was applied in order to obtain a length of metal exhibiting a worn metal surface, representative of the heat exchangers used on industrial units. After this preliminary treatment, the anticoke properties generated by the sulphur-silicon pretreatment and their stability were tested during 6 coking/decoking cycles.

The rates of coking observed on the length of metal placed in the heat exchanger, under standard cracking conditions, during each coking phase are shown in the following Table 2. The rates of coking of the length of metal pretreated with the additive based on sulphur and on silicon are compared with the rates of coking obtained under the same conditions on a length of metal of the same nature but which has not been subjected to any pretreatment.

The anticoke properties of the sulphur-silicon pretreatment are expressed by the term "inhibition of the coke", defined thus:

$$\text{"Inhibition of the coke"}(\%) = \frac{\left(\begin{array}{l}\text{Rate of coking on}\\ \text{a length of metal}\\ \text{which has not been}\\ \text{pretreated}\end{array}\right) - \left(\begin{array}{l}\text{Rate of coking}\\ \text{on a length of metal}\\ \text{pretreated with } S-Si\end{array}\right)}{\left(\begin{array}{l}\text{Rate of coking on}\\ \text{a length of metal}\\ \text{which has not been}\\ \text{pretreated}\end{array}\right)} \times 100$$

TABLE 2

Rates of coking of lengths of metal placed in the heat exchanger

| | Rates of coking ($\mu g \times cm^{-2} \times min^{-1}$) | | |
|---|---|---|---|
| | Untreated length of metal | Length of metal treated with S and Si | Inhibition of the coke (%) |
| Cycle 1 | 42 | 17 | 59 |
| Cycle 2 | 54 | 23 | 57 |

TABLE 2-continued

Rates of coking of lengths of metal placed in the heat exchanger

| | Rates of coking ($\mu g \times cm^{-2} \times min^{-1}$) | | |
|---|---|---|---|
| | Untreated length of metal | Length of metal treated with S and Si | Inhibition of the coke (%) |
| Cycle 3 | 66 | 31 | 53 |
| Cycle 4 | 84 | 38 | 55 |
| Cycle 5 | 90 | 52 | 42 |
| Cycle 6 | 100 | 64 | 36 |

The invention claimed is:

1. A process for reducing coking on the metal walls of a cracking reactor and a heat exchanger placed subsequent to the cracking reactor for cracking of a feedstock of hydrocarbons or of other organic compounds comprising:

pretreating the metal walls coming into contact with the organic compounds to be cracked with a stream of steam with at least one non-sulphur-containing silicon compound which is hexamethyldisiloxane and at least one non-silicon-containing sulphur compound which is dimethyldisulfide at a temperature between 300 and 1100° C. for 0.5 to 12 hours, wherein the Si:S atomic ratio is between 2:1 and 1:2 and the concentration of silicon is less than 500 ppm;

cracking the feedstock hydrocarbons or other organic compounds in the cracking reactor and heat exchanger; and decoking the cracking reactor and heat exchanger with a mixture of air and steam.

2. Process according to claim 1, wherein the pretreatment of the cracking reactor is carried out at a temperature of between 750 and 1050° C.

3. Process according to claim 1, wherein the pretreatment of the heat exchanger placed subsequent to the cracking reactor is carried out at a temperature of between 400 and 700° C.

4. Process according to claim 1, wherein the pretreatment is carried out for a time of 1 to 6 hours.

5. Process according to claim 1, wherein the steam used as carrier fluid additionally comprises an inert gas.

6. Process according to claim 1, wherein the concentration by mass of sulphur and silyl additives in the carrier fluid is between 50 and 5000 ppm, preferably between 100 and 3000 ppm.

7. Process according to claim 1, wherein pressure varies between 1 and 20 bar absolute, preferably between 1 and 5 bar absolute.

8. Process according to claim 1, wherein after the pretreatment, a sulphur compound and/or a silyl compound are added to the feedstock of the organic compound to be cracked.

9. Process according to claim 8, wherein the sulphur compound is dimethyl disulphide.

10. Process according to claim 8, wherein the silyl compound is hexamethyldisiloxane.

11. Process according to claim 8, wherein the Si:S atomic ratio does not exceed 2:1 and is preferably less than or equal to 1:2.

12. Process according to claim 8, wherein there is added, to the feedstock of organic compound to be cracked comprising sulphur, a silyl compound in an amount such that the Si:S atomic ratio does not exceed 2:1, and that the concentration of silicon does not exceed 500 ppm.

13. Process according to claim 8, wherein the concentration by mass of sulphur in the organic compound to be cracked is between 10 and 1000 ppm.

14. Process according to claim 6, wherein the concentration is between 100 and 3000 ppm.

15. Process according to claim 7, wherein the pressure is between 1 and 5 bar absolute.

16. Process according to claim 11, wherein the ratio is less than or equal to 1:2.

17. Process according to claim 12, wherein the ratio is less than or equal to 1:2.

18. Process according to claim 13, wherein the concentration is between 20 and 300 ppm.

19. A process for reducing coking on metal walls of a cracking reactor and a heat exchanger placed subsequent to the cracking reactor for the cracking of hydrocarbons or other organic compounds comprising;

pretreating the metal walls coming into contact with the organic compounds to be cracked with a stream of steam having at least one non-sulphur-containing silicon compound and at least one non-silicon-containing sulphur compound at a temperature between 300 and 1100° C. for 0.5 to 12 hours, such that the at least one non-silicon containing sulphur compound is carbon disulphide or a compound of formula $R^1$—Sx—$R^2$ in which $R^1$ and $R^2$, which are identical or different, each are representative of a hydrogen atom or hydrocarbonaceous group, and x is a number equal to or greater than 1, such that an inhibition of coke percentage on the metal walls of the cracking reactor and the heat exchanger is 36 to 66%;

cracking the feedstock hydrocarbons or other organic compounds in the cracking reactor and heat exchanger; and decoking the cracking reactor and heat exchanger with a mixture of air and steam.

20. The process according to claim 19, wherein the inhibition of coke percentage is 53 to 66%.

21. The process according to claim 19, wherein the at least one non-sulphur containing silicon compound comprises hexamethyldisiloxane and wherein the at least one non-silicon containing sulphur compound comprises dimethyldisulphide.

22. The process according to claim 21, wherein the Si:S atomic ratio is between 2:1 and 1:2.

23. The process according to claim 19, wherein the pretreatment of the cracking reactor is carried out at a temperature from 750° to 850° C.

24. The process according to claim 1, further comprising: repeating the cracking step and the decoking step.

25. The process according to claim 19, further comprising: repeating the cracking step and the decoking step.

* * * * *